United States Patent [19]

Wyatt

[11] 3,938,290

[45] Feb. 17, 1976

[54] SCAFFOLDING

[75] Inventor: Cyril F. Wyatt, Devon, England

[73] Assignee: Tower Scaffolding (Bristol) Limited, Bristol, England

[22] Filed: Feb. 4, 1974

[21] Appl. No.: 439,686

[52] U.S. Cl. ..... 52/646; 52/758 C; 182/178; 403/217

[51] Int. Cl.[2] ..... F04G 1/06

[58] Field of Search ..... 52/645, 646, 648, 758 W, 52/758 A, 758 R, 637, 638, 721, 754, 758 C; 403/199, 375, 217, 219, 245, 49; 211/182; 182/178, 151

[56] References Cited

UNITED STATES PATENTS

| | | | |
|---|---|---|---|
| 2,233,458 | 3/1941 | Segre | 52/758 C X |
| 2,308,832 | 1/1943 | Roney et al. | 182/178 X |
| 2,392,932 | 1/1946 | Macbeth | 52/758 C X |
| 2,446,372 | 8/1948 | Jones et al. | 52/637 |
| 3,321,222 | 5/1967 | Buncher | 182/178 Y |
| 3,798,851 | 3/1974 | Utahara | 52/758 A X |

FOREIGN PATENTS OR APPLICATIONS

| | | | |
|---|---|---|---|
| 559,535 | 7/1958 | Canada | 403/219 |
| 647,356 | 12/1950 | United Kingdom | 52/637 |

*Primary Examiner*—Frank L. Abbott
*Assistant Examiner*—Carl D. Friedman
*Attorney, Agent, or Firm*—John C. Smith, Jr.

[57] ABSTRACT

This invention relates to a scaffolding framework of horizontal and vertical scaffolding poles. The horizontal and vertical poles are joined together by scaffolding joints each comprising a pair of vertically disposed cheek plates spaced from one another and secured to an end of a horizontal scaffolding pole. The cheek plates are secured to said end on opposite sides thereof and project therefrom so as to embrace the adjoining vertical pole from opposite sides thereof. Said plates are each provided with a downwardly open socket which engages over a lug secured to and projecting transversely from the adjoining vertical pole.

18 Claims, 5 Drawing Figures

SCAFFOLDING

This invention relates to scaffolding framework of horizontal and vertical scaffolding poles which are joined together by scaffolding joints, and to poles for such a framework.

Scaffolding clamps are used to connect scaffolding members together and mutually at right angles to one another so that the members form a framework to support working platforms. These clamps must ensure that the framework is rigid and should be simple to use. On building sites, loose scaffolding clamps, which are expensive to replace, are often lost and, because of increasing labour costs, it is becoming more expensive to fit these loose clamps on site.

It is an aim of the present invention to provide a scaffolding pole and scaffolding framework which are such that the scaffolding clamps cannot be lost and the work normally involved in supporting and bolting horizontal poles to vertical poles is avoided.

According to the present invention there is provided a scaffolding framework of horizontal and vertical scaffolding poles wherein the horizontal and vertical poles are joined together by scaffolding joints, at least some of which comprise a pair of vertically disposed cheek plates spaced from one another and secured to an end of a horizontal scaffolding pole, said plates being rigidly secured to said end on opposite sides thereof and projecting therefrom so as to embrace the adjoining vertical pole from opposite sides thereof, one or both said plates being provided with a downwardly open socket which engages over a lug secured to and projecting transversely from the adjoining vertical pole.

Also according to the present invention there is provided a scaffolding pole for use in such a framework, said pole having at one or both ends a pair of cheek-plates rigidly secured thereto on either side thereof, said cheek plates projecting from said end for receiving therebetween a second scaffolding pole at right angles to the first pole one or both cheek plates having in one edge an open socket adapted to receive a lug secured to and projecting transversely from said second pole.

As the joint is fixed on the pole it cannot be lost on site. No work is needed to secure the joint to the pole on site, as is necessary with conventional clamps. The pole with the cheek plates can be simply slotted onto lugs on the vertical pole and no securing bolts are needed for this operation. This avoids the labour costs on the work normally involved when fixing scaffolding poles together with prior clamps. The rigid fixing of the plates on the pole offers rigidity to the scaffolding framework and enables the scaffolding readily to meet current trade and safety requirements. Moreover, the present invention enables the weight of the scaffolding framework to be substantially reduced and simplifies transportation.

When the cheek plates are shaped to receive a third scaffolding pole at angle to the first and second poles and means are provided to clamp said third pole in position relative to said first and second poles, the scaffolding pole still only has a single bolt and yet has the same capabilities as a substantially more complex multiple-bolt scaffolding joint.

The clamping means may comprises a plate mounted between said cheek plates and a screw-threaded bolt threadedly mounted in an aperture in said plate and operable to clamp said second horizontal pole in said jaw. The cheek plates are preferably welded to the end of the horizontal scaffolding pole.

In the framework, the vertical poles are preferably provided with a plurality of lugs at intervals along the length thereof for locating the horizontal poles at a variety of different heights. Advantageously, the downwardly open socket comprises a downwardly open vertical slot in the lower edge of one or both cheek plates and the lug or lugs on the vertical pole comprise projecting fins which are a close fit in said vertical slots.

An example of the invention will now be particularly described with reference to the accompanying drawings, in which.

Figure 1:
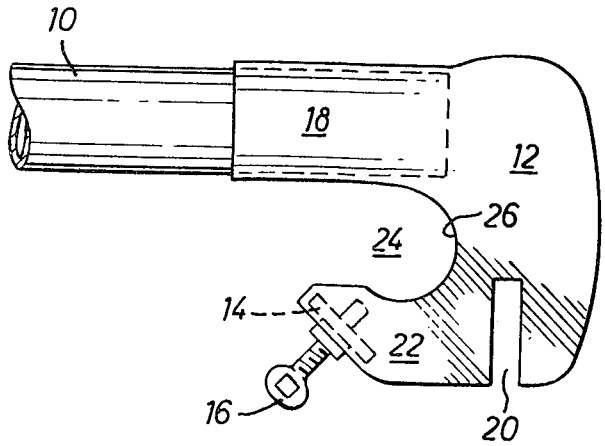
FIG. 1 shows part of a horizontal cross-member scaffolding pole for a scaffolding framework.
Figure 3:
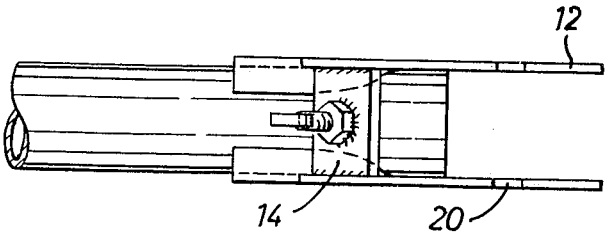
FIG. 3 is a plan view of the pole of FIG. 1 as seen from below.
Figure 2:
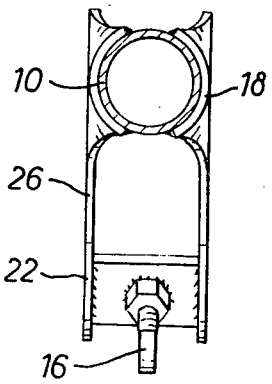
FIG. 2 is an end elevation of the part of the pole shown in FIG. 1.

Referring firstly to FIGS. 1 to 3, the scaffolding pole comprises a tube 10, two cheek plates 12 welded one to each side of the tube adjacent the end thereof, a transverse plate 14 welded between the cheek plates and a bolt 16 screwed into a threaded aperture in the plate 14. Each of the cheek plates has a projecting portion 18 which is bent to fit closely against the periphery of the tube 10 and is welded along its edges to the tube. In this embodiment, the weld seams are spaced well apart. The main part of the plates 12 from which the portions 18 project each have a smoothly curved edge extending from an end of the projection 18 to one end of an enlarged slot 20. The slot 20 is substantially rectangular and it extends substantially perpendicularly to the axis of the tube 10 as seen in FIG. 1.

The plate 14 is welded to a hooked portion 22 of each cheek plate, the portion 22 of the plate being spaced from the portion 18 by an opening 24. Each opening 24 has a curved end 26 against which a scaffolding pole can be pressed by the scaffoling bolt 16. The mouth of the opening through which a scaffolding pole can be inserted into the opening is wider than the diameter of curvature of the end 26, thus simplifying insertion of the scaffolding pole into the opening. The curved end 26 is off-set with respect to the mouth of the opening 24 so that any scaffolding pole inserted into the opening must move through a curve before it reached the end 26 thereof.

Figure 4:
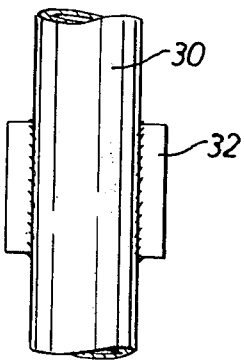
FIG. 4 is an elevation of a vertical scaffolding pole for use with the pole of FIGS. 1 to 3.

The tube 10 is identical at each end and can be used in a scaffolding framework with the vertical scaffolding pole shown in FIG. 4. The vertical scaffolding pole of FIG. 4 comprises a tube 30 and two lugs in the form of shear blocks 32 welded at their ends to the tube 30. The tops of the shear blocks 32 are coplanar.

In use, two of the vertical scaffolding poles are spaced apart a distance equal to the distance between the slots 20 at opposite ends of the tube 10. Then, the cheek plates 12 of each scaffolding arrangement are slotted over the tube 30 with one cheek plate on each side of the tube. The slots 20 are located above the shear blocks 32 at this stage. The tube 10 is then lowered so that the shear blocks 32 fit snugly into the slots in the cheek plates 12, the tube 10 thus being held in a horizontal position. The tube 30 has pairs of shear blocks at predetermined positions along its length so that the tube 10 can be supported at any height predetermined by the position of the shear blocks.

Figure 5:
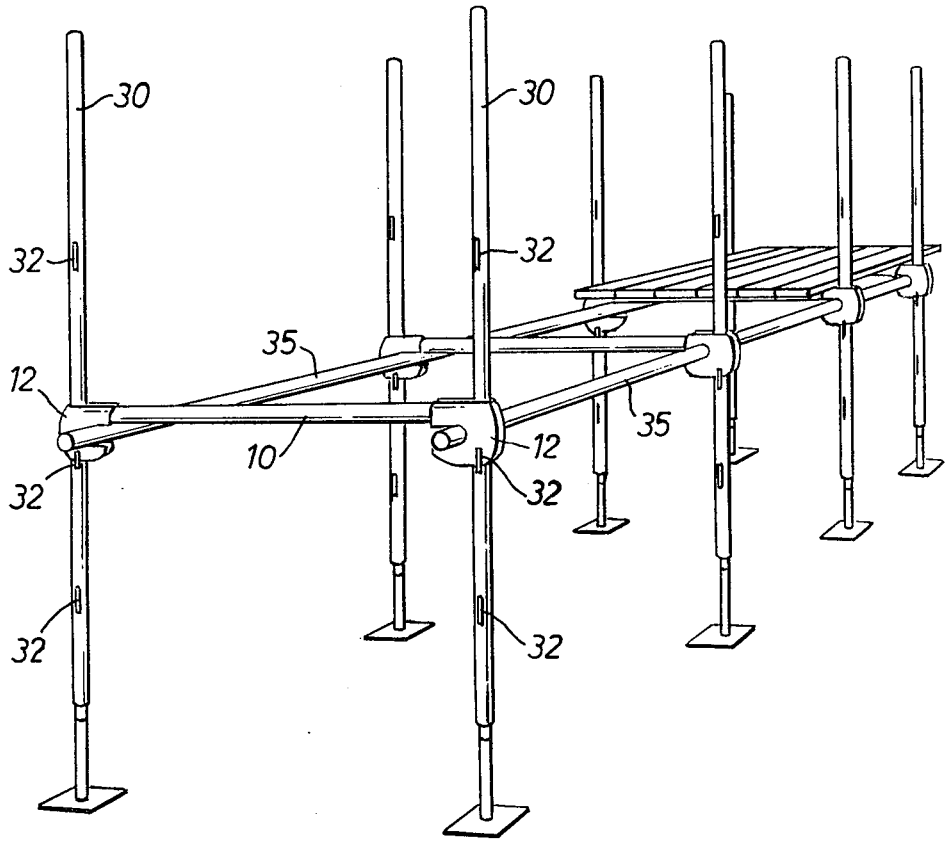
FIG. 5 shows in perspective, a scaffolding framework made up from the scaffolding poles illustrated in FIGS. 1–4.

As shown in FIG. 5, another set of horizontal and vertical poles can be connected together as described above and positioned adjacent to the first set so that the axes of curvature of the ends 26 of opening 24 of cheek plates 12 of adjacent horizontal poles are aligned. Then further horizontal ledger poles 35, mutually at right angles to the tubes 10 and 30, can be received in adjacent openings and secured in the openings by the bolts 16. The bolts 16, when tightened, bear directly on the ledger pole in the opening 24 and prevent the ledger poles from sliding longitudinally in the opening.

By connecting further scaffolding poles to the vertical poles and by fixing further horizontal poles thereto, it is thus possible to erect a complete scaffolding framework. Since the slots 20 in the cheek plates 12 fit snugly over the shear blocks 32, the plates cannot rock on the blocks 32 and the erected framework can therefore be extremely rigid.

Although the vertical scaffolding member has been shown with a rectangular shear block secured thereto, this may be replaced by an inverted T-shaped lug welded to the tube 30. Also, the cheek plates 12 may be formed from a single sheet of metal folded over the tube 10 and secured thereto. The weld seams along the adjacent edges of the portions 18 then are no longer necessary.

I claim:

1. A scaffolding framework comprising:

a. a plurality of spaced, vertical scaffolding poles, each having at least one pair of diametric lugs extending transversely therefrom at opposite side thereof and intermediate the ends thereof, b. at least one horizontal pole having a scaffolding joint at each end thereof for engaging respective of said vertical poles, c. each scaffolding joint comprising a pair of vertically disposed cheek plates spaced from each other and projecting beyond said end of said horizontal pole and forming an open-sided vertical channel therebetween receiving an intermediate part of an adjoining vertical pole, the width of the opening in the side of the channel being sufficient for said vertical pole to pass laterally therethrough and each of said cheek plates having a downwardly open recess therein engaging one of said pair of lugs on the adjoining vertical pole, d. whereby said horizontal pole is supported against axial movement by the lugs and may be lowered and raised to cause said open recesses in said pair of cheek plates to engage and disengage respectively said pair of lugs and, when raised, may be moved horizontally towards and away from said vertical pole to cause the intermediate part of said vertical pole to pass through the opening in said vertical channel.

2. A scaffolding framework according to claim 1 wherein the vertical poles are provided with a plurality of said pair of lugs at intervals along the length thereof for locating the horizontal poles at a variety of different heights.

3. A scaffolding framework according to claim 1 wherein the pair of cheek plates include recesses to receive a second horizontal pole at an angle to the first horizontal pole, said joint further comprising clamping means to clamp said second pole in position in said recesses at said angle.

4. A scaffolding framework according to claim 3 wherein each cheek plate is provided with a downwardly hooked portion which forms a jaw to receive said second horizontal pole at right angles to the first horizontal pole.

5. A scaffolding framework according to claim 4 wherein the clamping means comprises a plate mounted between said pair of cheek plates and a screw-threaded bolt threadedly mounted in an aperture in said plate and operable to clamp said second horizontal pole in said jaw.

6. A scaffolding framework according to claim 5 wherein each of said recesses formed by said hooked portion has a mouth in one side thereof and a curved portion opposite said mouth off-set with respect to said mouth and said plate and bolt are located between the hooked portions of said cheek plates adjacent said off-set curved portion.

7. A scaffolding framework according to claim 1 wherein each of the downwardly open recesses comprises a downwardly open vertical slot in the lower edge of each cheek plate and each of the lugs on the vertical pole comprises a projecting fin which closely fits in said vertical slot.

8. A scaffolding framework according to claim 7 wherein the lug is of rectangular elevation with a longer dimension in the vertical direction.

9. A scaffolding framework according to claim 7 wherein the lug is of inverted T-shaped elevation.

10. A scaffolding framework according to claim 1 wherein the cheek plates are welded to the end of the horizontal scaffolding plate.

11. A scaffolding member comprising:

a. a pole and b. a scaffolding joint at at least one end thereof, c. said scaffolding joint comprising a pair of cheek plates spaced from each other and projecting beyond the end of said pole and forming an open-sided channel therebetween for receiving a second pole intermediate the ends thereof and at right angles to said first pole, the width of the opening in the side of the channel being sufficient for said second pole to pass laterally therethrough, and both of said cheek plates each having an open recess in one edge thereof for receiving a pair of diametric lugs extending from opposite sides of a second pole intermediate the ends thereof, d. whereby the cheek plates and thus said first pole may be supported and held against axial movement by the lugs when the poles are assembled with the first pole horizontal and the second pole vertical and the first pole may be moved laterally to cause said open recesses in said pair of cheek plates to engage and disengage respectively said pair of lugs and may be moved axially to cause the intermediate part of said second pole to pass through the opening in said channel.

12. A scaffolding member according to claim 11 wherein each of said recesses comprises an open-ended slot formed in an edge of each cheek plate, said slots in said pair of cheek plates being adapted to fit over a pair of projecting fins formed on opposite sides of said second pole.

13. A scaffolding member according to claim 12 wherein the pair of cheek plates include recesses to receive a third scaffolding pole at an angle to the first and second poles, said joint further comprising means to clamp said third pole in position in said recesses relative to said first and second poles.

14. A scaffolding member according to claim 13 wherein each cheek plate is provided with a hooked portion which forms a jaw to receive said third pole at right angles to said first and second poles.

15. A scaffolding member according to claim 14 wherein the clamping means comprises a plate mounted between said pair of cheek plates and a screw-threaded bolt threadedly engaged in an aperture in said plate and operable to clamp said third pole in said jaw.

16. A scaffolding member according to claim 15 wherein each of said recesses formed by said hooked portion has a mouth in one side thereof and a curved portion opposite said mouth off-set with respect to said mouth and said plate and bolt are located between the hooked portions of said cheek plates adjacent said off-set curved portion.

17. A scaffolding member according to claim 11 wherein the cheek plates are welded to the pole.

18. A scaffolding framework comprising:

a. a plurality of spaced, vertically oriented scaffolding poles, each having a plurality of pairs of diametric lugs extending transversely therefrom at intervals on opposite sides thereof along the length thereof, each lug being of rectangular elevation with a longer dimension in the vertical direction, b. at least one horizontal pole having a scaffolding joint at each end thereof for engaging respective of said vertical poles, c. each scaffolding joint comprising a pair of vertically disposed cheek plates spaced from each other and projecting beyond said end of said horizontal pole and forming an open-sided vertical channel therebetween receiving an intermediate part of an adjoining vertical pole, the width of the opening in the side of the channel being sufficient for said vertical pole to pass laterally therethrough, each of said cheek plates having a downwardly open vertical slot in the lower edge thereof for closely fitting one of said pair of lugs on said vertical pole and each cheek plate having a downwardly hooked portion forming a jaw about a portion of a recess adapted for receiving a second horizontal pole at an angle to the first horizontal pole, clamping means being provided to clamp said second pole in position in said recess at said angle, d. whereby said horizontal pole is supported and held against axial movement by the lugs and may be lowered and raised to cause said open recesses in said pair of cheek plates to engage and disengage respectively said pair of lugs and, when raised, may be moved horizontally towards and away from said vertical pole to cause the intermediate part of said vertical pole to pass through the opening in said vertical channel.

* * * * *